US006694027B1

(12) United States Patent
Schneider

(10) Patent No.: US 6,694,027 B1
(45) Date of Patent: Feb. 17, 2004

(54) DISCRETE MULTI-CHANNEL/5-2-5 MATRIX SYSTEM

(75) Inventor: Norman R. Schneider, Chamblee, GA (US)

(73) Assignee: Smart Devices, Inc., Norcross, GA (US)

( * ) Notice: Subject to any disclaimer, the term of this patent is extended or adjusted under 35 U.S.C. 154(b) by 0 days.

(21) Appl. No.: 09/265,270

(22) Filed: Mar. 9, 1999

(51) Int. Cl.[7] ..... H04R 5/00
(52) U.S. Cl. ..... 381/20
(58) Field of Search ..... 381/20, 19, 21, 381/22, 23, 1

(56) References Cited

U.S. PATENT DOCUMENTS 3,632,886 A 1/1972 Scheiber
3,746,792 A 7/1973 Scheiber
3,959,590 A 5/1976 Scheiber
4,589,129 A 5/1986 Blackmer et al.
4,680,796 A 7/1987 Blackmer et al.
4,799,260 A 1/1989 Mandell et al.
5,172,415 A 12/1992 Fosgate
5,319,713 A 6/1994 Waller, Jr. et al.
5,333,201 A 7/1994 Waller, Jr.
5,771,295 A 6/1998 Waller, Jr.

*Primary Examiner*—Ping Lee
(74) *Attorney, Agent, or Firm*—Frank J. Catalano

(57) ABSTRACT

An encode/decode 5-2-5 matrix system is combined with a discrete digital, multi-channel audio system to expand the number of independently addressable output channels. One embodiment of the system provides additional output channels by matrix encoding the additional audio information into the rear surround channels of a discrete digital five channel surround system. The expanded channels provide additional center surround and left and right overhead outputs. The 5-2-5 matrix channel separation is improved by increasing the surround channel attenuation when no dominant surround signal is present in the input to the 5-2-5 matrix decoder. In a second embodiment the system provides a surround encode/decode system offering eleven independently addressable output channels.

2 Claims, 6 Drawing Sheets

DISCRETE MULTI-CHANNEL/5-2-5 MATRIX SYSTEM

BACKGROUND OF THE INVENTION

1. Field of the Invention

The present invention generally relates to multi-channel audio surround systems and more specifically relates to discrete multi-channel audio systems combined with multi-channel matrix surround systems.

2. Description of the Related Art

Matrix surround systems have been commonly known and used for approximately thirty years. The work of Peter Scheiber in the late sixty's and early seventy's is perhaps the most well known. The basic concept of a matrix system is to expand the number of audio channels available from a two channel stereo recording, or transmission media. Anyone skilled in the art is knowledgeable of the fact that the commonly known "Dolby Stereo" cinema systems as well as the "Dolby Pro Logic" consumer systems are based on the original patents issued to Peter Schieber. The Dolby system is referred to as a 4-2-4 matrix system. The obvious requirement of all matrix systems is that a discrete two channel recording or transmission media (Left and Right channels) must be available to allow additional channels to be added as a L+R and or L−R signal. It is also obvious to the skilled artisan that any existing stereo, or pair of two or more discrete channels of audio, can be enhanced with the use of any of the existing matrix systems. This would include stereo recordings, FM stereo broadcast, cable TV transmission, internet audio and DVD audio to name a few of the countless possible applications. It also becomes obvious to anyone skilled in the art to consider the application of matrix enhancement to any of the discrete multi-channel audio formats such as Dolby Digital (AC-3), DTS (Digital Theater Systems), or the Sony format known as SDDS. The most obvious application would be to enhance the stereo rear or "surround" channels by applying a 4-2-4 matrix system. Anyone skilled in the art quickly realizes that with any of the above mentioned discrete multi-channel systems, any one of the known matrix decoders including Dolby Pro-Logic, can be connected to the left and right surround outputs. The obvious result is that any dominate audio originally mixed equally in both of the surround channels would produce a center surround output from the center output of the Dolby Pro-Logic decoder.

It is also obvious to one skilled in the art that by using the Left and Right front outputs from the matrix decoder for the left and right surround outputs, center surround audio will be subtracted from the left and right output. This would provide the user with a six channel system having a potential benefit for all of the currently available releases in any of the above mentioned discrete multi-channel formats. The above described system can easily be realized, by any consumer, by connecting one of the currently available consumer "Digital Systems", Dolby Digital or DTS, with one of the available consumer matrix systems. There are several matrix decoding systems that could be used, as is obvious to those skilled in the art. The Dolby Pro-Logic system is used as an example of the most commonly available system. The combined system described above has already been realized in numerous professional cinema application and will illustrate an example of the prior art. A number of professional cinemas have connected one of the commercially available professional discrete digital systems with one of the commercially available professional matrix decoders. The combined system was connected to provide the cinema system with a center surround channel. As previously mentioned a center surround signal is naturally present in virtually all of the current source material. This demonstrates the obviousness of the simple combination of the two systems. Other prior art matrix systems have offered six output channels, which included a center surround output. One prior art system is disclosed in U.S. Pat. No. 4,589,129 and also in U.S. Pat. No. 4,680,796 both issued to David E. Blackmer and James H. Townsend. Still another example of a matrix system offering a center surround output is disclosed in U.S. Pat. No. 5,172,415 issued to James W. Fosgate.

These prior art examples did not produce the level of separation that is obtained from the present invention, and in the Blackmer system there was no steering in the surround channels, which is required to enhance channel separation. The Blackmer system simply produced a pseudo stereo output for the left and right surround outputs, and an unaltered center surround output. The above examples illustrate the ongoing desire to increase the number of output channels in a surround system in order to improve localization and increase realism.

A relatively new matrix system, which has become commercially available in the past few years is a system called Circle Surround. The Circle Surround system is a 5-2-5 matrix system allowing five channels to be encoded down to two and then decoded back to five channels. The Circle Surround 5-2-5 matrix system is disclosed in U.S. Pat. No. 5,771,295 issued to James K. Waller Jr. The benefits of the 5-2-5 system over that of the Dolby Pro-Logic 4-2-4 matrix are clearly disclosed in the Waller patent. The advantages of combining the Circle Surround 5-2-5 matrix system with a discrete multi-channel audio system will become apparent after reading the disclosure of the current invention. In summary, the prior art systems lack the ability to provide more than one additional center surround channel and did not anticipate additional side or overhead channels. The prior art systems provided the additional center channel as an L+R signal that was naturally present as the summation of the two original channels. The prior art systems also did not anticipate the possibility of stereo encoded L−R channels, or symmetrically encoded channels.

SUMMARY OF THE INVENTION

The present invention discloses an improved, expanded, combined discrete multi-channel/5-2-5 matrix system and the benefits of said system. It is an object of the current invention to offer additional channel enhancement to that available with the prior art systems by enhancing a multi-channel discrete system with 5-2-5 matrix encoded audio, mixed into at least two of the available discrete audio channels. It is a further object of the invention to offer the possibility of symmetrical channel enhancement. By encoding 5-2-5 matrix audio into any two of the five channels available, with Dolby Digital and DTS (Digital Theater Systems), or seven channels available with the Sony SDDS system, and then decoding with a Circle Surround decoder, the benefits of the invention are realized. As previously mentioned, the invention can also be used with the multi-channel discrete DVD audio format, which offers multiple discrete channels of audio. It is a further object of the invention to allow adjacent and or diagonal discrete channels to be used for additional matrix encoded channels. It is yet a further object of the invention to provide additional channel separation over that of the current Circle Surround system. The requirements of the stand alone system differ from that of the disclosed invention, and further improvements in performance are derived by providing surround channel attenuation when there is no dominate L−R signal present. This will be further explained in the detailed description of the invention.

In the first embodiment of the invention a 5-2-5 matrix system is added to the surround channels of a discrete digital surround system providing an additional center surround channel and a pair of additional L−R channels. The additional L−R channels can be used for either overhead or side channels.

In a second embodiment of the present invention a multi-channel system is disclosed that offers symmetrical side and overhead channels to be added as L+R and L−R channels.

In a third embodiment of the present invention a multi-channel system is disclosed that combines both of the first two embodiments with additional channels provided by encoding L+R signals and or L−R signals in the front two audio channels.

The third embodiment provides for a total of up to fourteen available and independently addressable channels. As previously stated further improvements in the system performance are also achieved by reducing the gain in the surround channels of the 5-2-5 decoder when there is no dominate L−R information present in the input audio.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
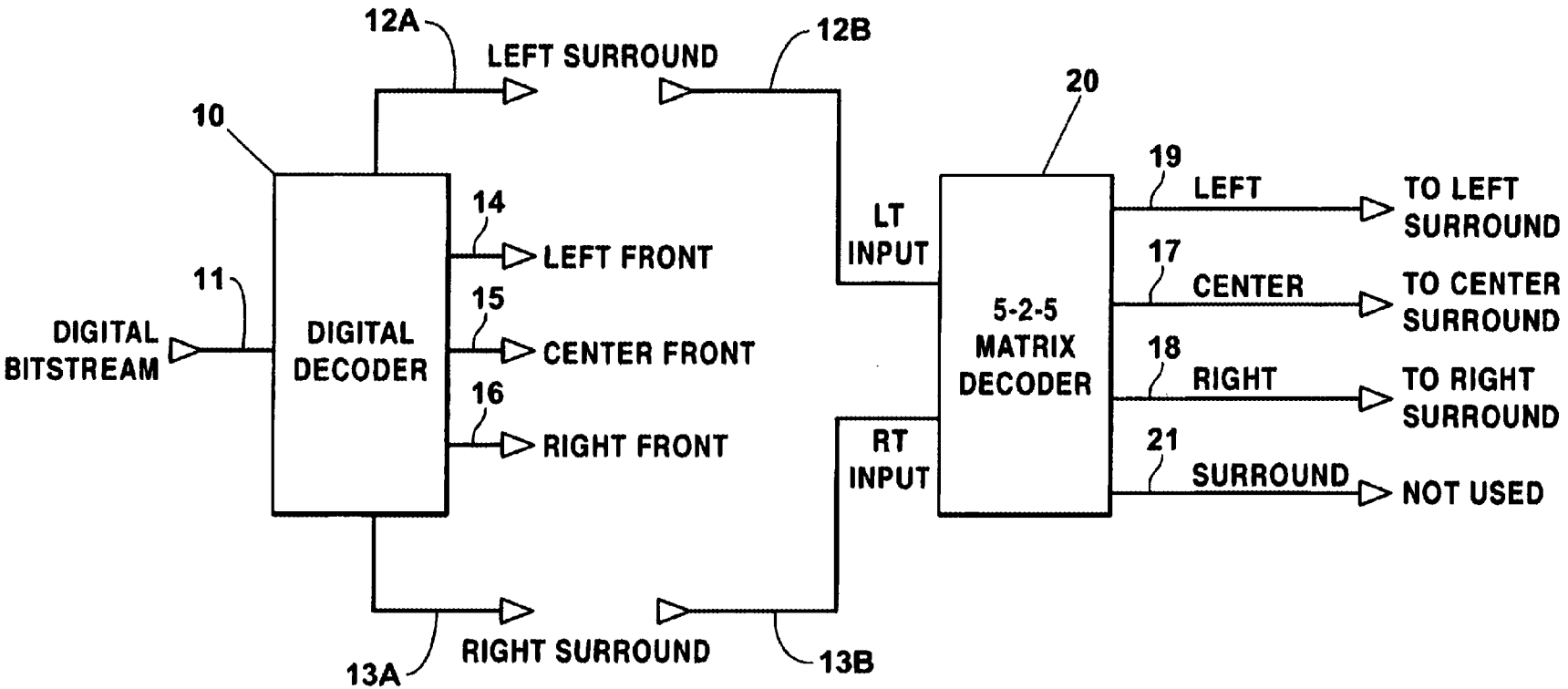
Fig. 1 ( PRIOR ART )
FIG. 1 is a block diagram of the prior Art.

Referring to FIG. 1 a prior art system is shown where the rear, or surround channels of a professional discrete multi-channel cinema system, is connected to a 4-2-4 matrix system. As previously described, any of the professional movie releases will likely contain sections of the audio mix with dominate L+R center surround information. When dominate center surround information is present, the externally connected matrix system will subtract the center dominate audio from the left and right outputs and produce a hard center output at the center output of the matrix system. There will not be any encoded L−R, or anti-phase audio present and therefore the surround output will produce little or no output, with the exception of the remote possibility of an occasional phantom surround signal. Phantom surround audio will sometimes occur in complex audio such as music or complex sound effects. This phantom surround signal will not contain dominant anti-phase signals. It is, however, possible for subtle anti-phase audio to sometimes occur without any encoding. For this reason the surround channel would produce little or no output and, therefore, provide little impact in the prior art systems. The prior art system has been used in a number of professional cinema installations. It is also possible for any consumer to connect one of the currently available discrete multi-channel systems with one of the consumer matrix systems and realize the same performance described above.

Figure 2:
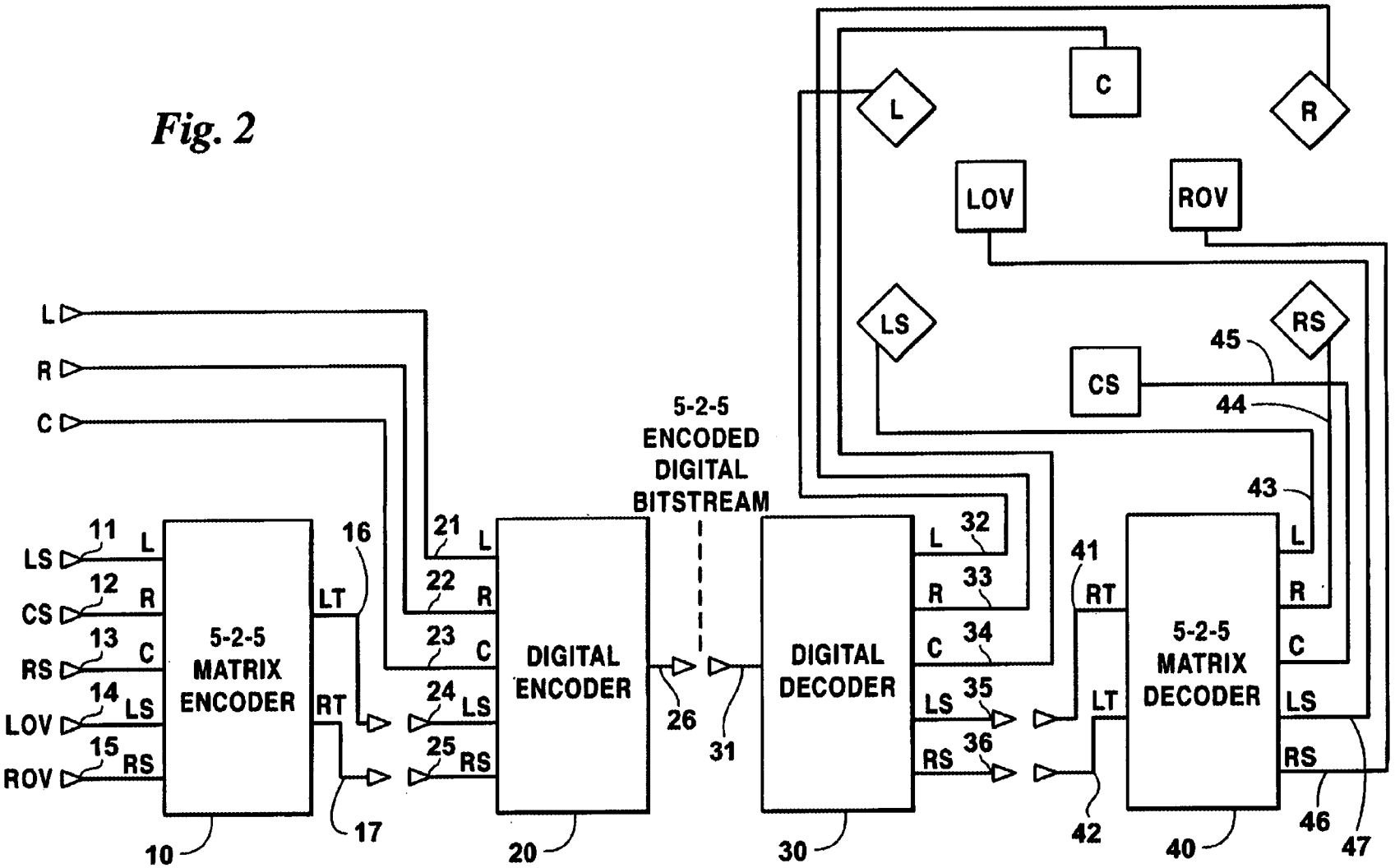
FIG. 2 is an example of an eight channel embodiment of the invention.

Referring to FIG. 2. a block diagram example of a first embodiment of the current invention is shown. The embodiment shown provides for an eight channel discrete digital/5-2-5 matrix system with the enhancements of an additional center surround channel and stereo left and right overhead channels. A 5-2-5 matrix encoder, such as the commercially available Circle Surround encoder from Rocktron, receives five external inputs. The operation of the Circle Surround 5-2-5 matrix decoder is fully described in the U. S. Pat. No. 5,771,295 issued to James Waller.

The LT output 16 and RT output 17 of the encoder 10, feed the left surround input 24 and right surround input 25 of a digital encoder 20. The combined encoders 10 and 20 offer a total of eight audio inputs including left surround input 11, center surround input 12, right surround input 13, left overhead input 14, right overhead input 15, left front input 21, right front input 22, and center front input 23. The LT and RT stereo outputs 16 and 17, respectively, are connected to the left and right surround inputs 24 and 25 of the digital encoder 20. The digital encoder 20 produces a digitally compressed, 5-2-5 matrix encoded output in the form of a digital bit stream at output 26. The input 31 of a complementary digital decoder 30, receives the digital bit stream output 26 from digital encoder 20. The left surround output 35 and right surround output 36 of digital decoder 30 provide a 5-2-5 matrix encoded stereo output. The surround outputs 35 and 36 of the digital decoder 30 feed the 5-2-5 matrix decoder left LT and right RT inputs 41 and 42, respectively. The 5-2-5 matrix decoder 40 provides decoding of the left surround output 43, right surround output 44, center surround output 45, left overhead output 46 and right overhead output 47. The front channel outputs, left front 32, right front 33, and center front 34 are all available directly from the digital decoder 30. The system disclosed provides for eight channels of audio with three additional channels that were not available with the original discrete digital system. The system also provides for a pair of symmetrical overhead channels LOV and ROV. The L−R overhead channels require anti-phase encoding in order to produce a dominant output. The stereo overhead channels greatly elevate the sonic experience and realism which can be obtained from a surround system. The system disclosed will allow for signals to be encoded with greater than 360 degree panning potential. Audio signals can be panned from left front, to left overhead, to right overhead, to right surround. This new level of localization is a major step toward reaching true realism in sonic performance.

Figure 3A:
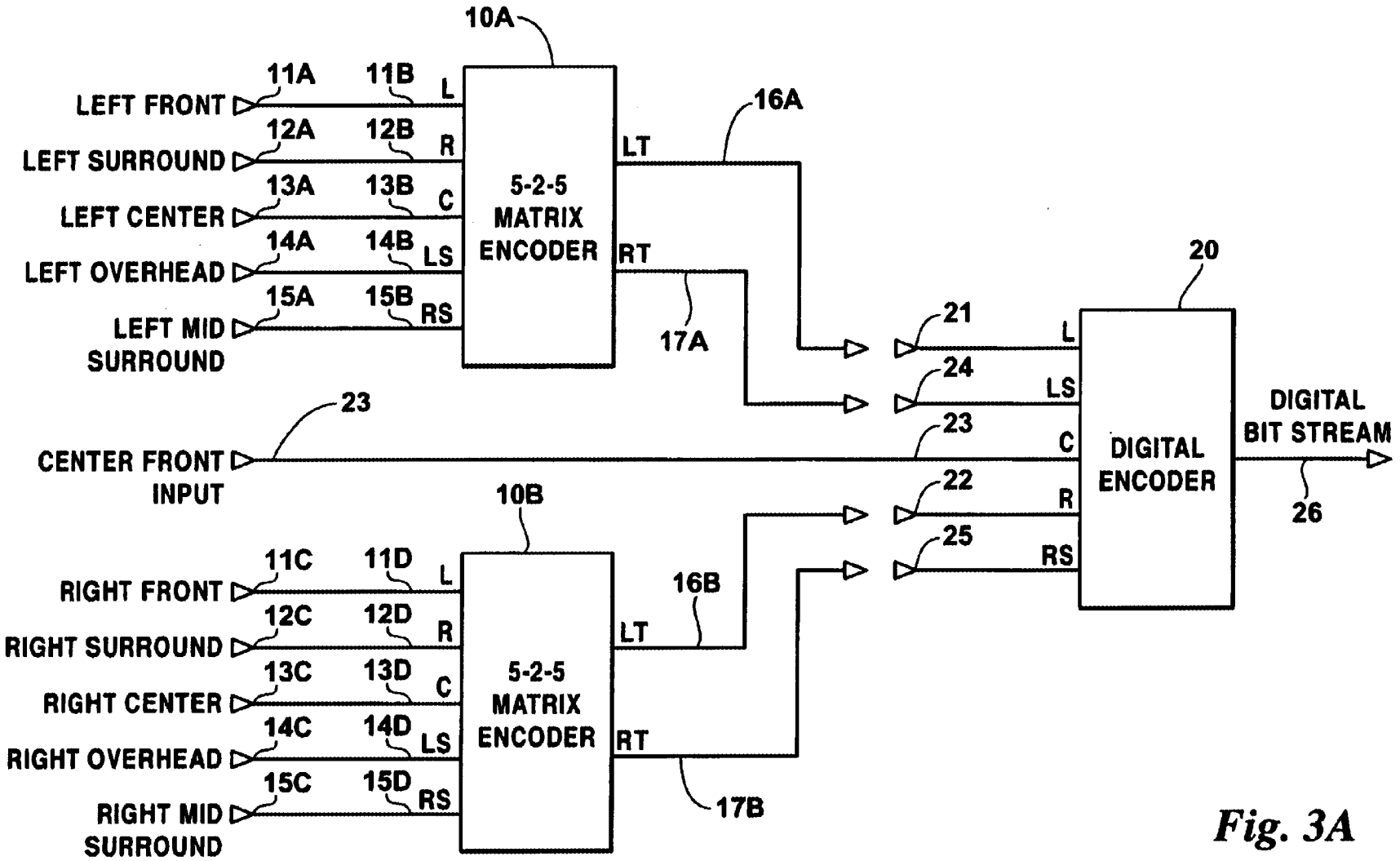
FIG. 3A is an example the encoder portion an eleven channel embodiment of the invention.
Figure 3B:
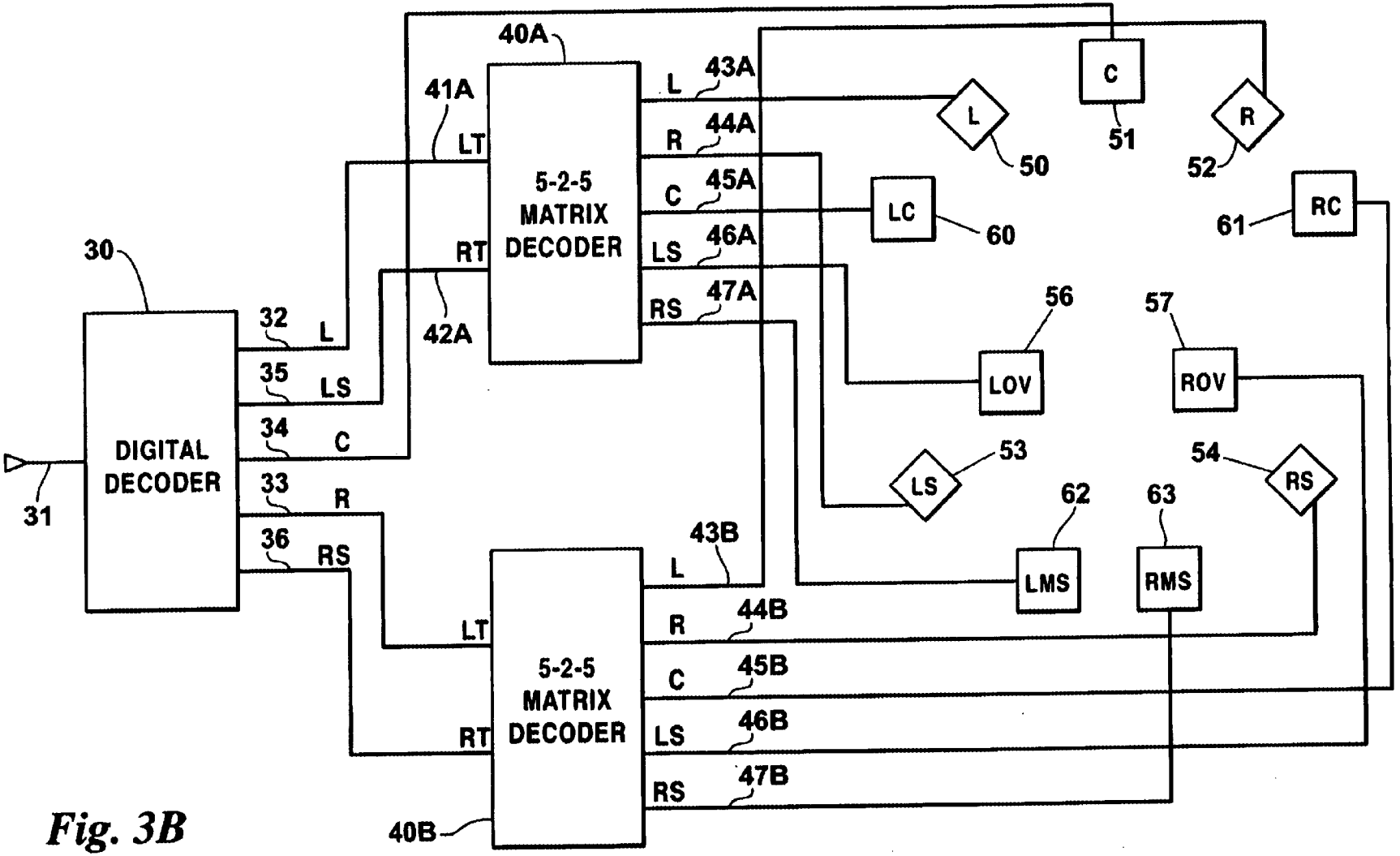
FIG. 3B is an example the decoder portion an eleven channel embodiment of the invention.

Referring to FIGS. 3A and 3B, a second embodiment of the invention is disclosed wherein the same numbers are used to depict the same functions performed in the description of FIG. 2. In the second embodiment of the invention, the additional encoded L−R channels are used to provide additional side channels. The additional side channels require 5-2-5 matrix encoding of the standard digital surround channels in order to produce a dominate signal in the surround outputs. The operation of the system disclosed in the second embodiment is the same as that of the first embodiment with the additional channels used for side surround channels. It is desirable to have the complete decoding system setup for monitoring of a mix for accurate sound localization.

FIG. 3A shows the encode portion and FIG. 3B shows the decode portion of an eleven channel embodiment of the invention, in which two 5-2-5 matrix encoders and two 5-2-5 matrix encoders and decoders are used in conjunction with a discrete digital surround system. Referring to FIG. 3A, two 5-2-5 matrix encoders 10A and 10B, receive ten of the eleven total input signals of the system. The matrix encoder 10A receives all five of the left input signals. The left front input 11B of the matrix encoder 10A receives the left input to the system at 11A. The right input 12B of the matrix encoder 10A receives the left surround input to the system at 12A. The center input 13B of the matrix encoder 10A receives the left center side input to the system at 13A . The left surround input 12B of the matrix encoder 10A receives the left overhead input to the system at 14A. The right surround input 15B of the matrix encoder 10A receives the left middle surround input to the system at 15A. The matrix encoder 10B receives all five of the right input signals of the system. The left front input 11D of the matrix encoder 10B receives the right front input to the system at 11C. The right front input 12D of the matrix encoder 10B receives the right surround input to the system at 12C. The center input 13D of the matrix encoder 10B receives the right center side input to the system at 13C. The left surround input 12D of the matrix encoder 10B receives the right overhead input to the system at 14C. The right surround input 15D of the matrix encoder 10B receives the right middle surround input to the system at 15C. The center input to the system 23A is fed directly to the center input 23B of the digital encoder 20. The matrix encoded digitally compressed output appears as a digital bit stream at digital encoder output 26. The digital bit stream can be stored to a storage media such as professional cinematic film, digital audio tape, a DVD audio track or any other commonly known digital storage media.

Referring now to FIG. 3B, it is understood that the digital bit stream can also be transmitted by any of the conventional digital transmission formats. In either case the digital bit stream is applied to the input of digital decoder 30. The digital decoder 30 produces five standard audio outputs as left 32, right 33, center 34, left surround 35, and right surround 36. The left front output 32 and the left surround output 34 of the digital decoder 30, respectively, feed the left total input 41A and the right total input 42A of the 5-2-5 matrix decoder 40A. The five outputs of 5-2-5 matrix decoder 40A thus produce all of the left channel outputs of the system. The left front output 43A of the matrix decoder 40A produces the left front output of the system at 50. The right front output 44A of the matrix decoder 40A produces the left surround output of the system at 53. The center front output 45A of the matrix decoder 40A produces the left center side output of the system at 56. The left surround output 46A of the matrix decoder 40A produces the left overhead output of the system at 56. The right surround output 47A of the matrix decoder 40A produces the left middle surround output of the system at 62. The front center output 34 of the digital decoder 30 produces the center front output of the system at 51. The right front output 33 and right surround output 36 of digital decoder 30, respectively, feed the left total input 41B and the right total input 42B of the 5-2-5 matrix decoder 40B. The five outputs of the 5-2-5 matrix decoder 40B thus produce all of the right channel outputs of the system. The left front output 43B of the matrix decoder 40B produces the right front output of the system at 52. The right front output 44B of the matrix decoder 40B produces the right surround output of the system at 54. The center front output 45B of the matrix decoder 40B produces the left center side output of the system at 61. The left surround output 46B of the matrix decoder 40B produces the right overhead output of the system at 57. The right surround output 47B of the matrix decoder 40B produces the right middle surround output of the system at 63.

In operation, the additional channels are derived by encoding an L+R and stereo L−R signals into a pair of discrete digital inputs of the digital encoder 20. For example the surround inputs 14B and 15B of the matrix encoder 10A receive the system inputs for left overhead 14A and left middle side surround 15A. The overhead and side input signals are encoded as anti-phase or L−R signals in the left front input 21 and left surround input 24 of the digital encoder 20. The L−R signals are further encoded down to a single digital bit stream 26 and fed to the input 31 of the digital decoder 30. The digital decoder 30 will decode the digital bit stream 26 and output a stereo pair of matrix encoded signals at 32 and 35. The decoder outputs feed the left total and right total inputs of the matrix decoder 40A. The matrix decoder 40A then decodes the dominate L−R signals and feeds the decoded signals to the appropriate outputs of the system at 56 and 62. An input signal at the left center side input 13A will be encoded as an L+R signal at the left total and right total outputs 16A and 17A of the matrix encoder 10A. The L+R signal is further encoded down to a digital bit stream and fed to the input 31 of the digital decoder 30. The digital decoder 30 will decode the digital bit stream and output a stereo pair of matrix encoded signals at 32 and 35. The decoder outputs feed the left total and right total inputs 41A and 42A of the matrix decoder 40A. The matrix decoder 40A then decodes the dominate L+R signals and feeds the decoded signal to the appropriate output, left center side, at 60. When a dominate L+R signal is detected at the input of the matrix decoder 40A, the dominate center information will also be subtracted from the matrix decoder outputs 43A and 44A. The result is that the left center side audio will only be present at the system output 60 and will not appear in the other front channel matrix decoder outputs 43A and 44A. The center channel signal will also be cancelled in the surround output channels of the matrix decoder 40A, due to the fact that the surround outputs are derived by subtracting the right input from the left input. Signals fed only to the left input or right input of the encoder 1OA will appear only in the left or right output of the matrix decoder 40A. The operation of the right channels are identical to that described above for the left channels, with the exception that the right front and right surround channels of the digital encoder 20 and decoder 30 are used. The center front channel input of the system 23 passes directly through the digital encoder 20 and produces an output at the digital decoder 30 output 34 and finally feeds the center output of the system at 51.

The embodiment described above achieves the goal of providing a system that is symmetrical in operation. For each additional left channel provided there is a symmetrical right channel. This is desirable in order to provide the additional enhanced channels as stereo pairs. The current invention can also be applied to channels diagonally as will become apparent to the skilled artisan upon reading the current disclosure. For example, the left total and right total outputs of a 5-2-5 matrix encoder can be connected to feed the left front and right surround inputs of a discrete digital encoder providing a diagonal encoding pattern. As will become apparent to the skilled artisan upon reading this disclosure, there are numerous connection and channel pair options which can be realized offering up to twenty five possible additional encoders and decoders to be used. The current invention is not intended to be limited by the embodiments disclosed but to also include all of the alternatives that will be apparent to those skilled in the art.

Figure 4:
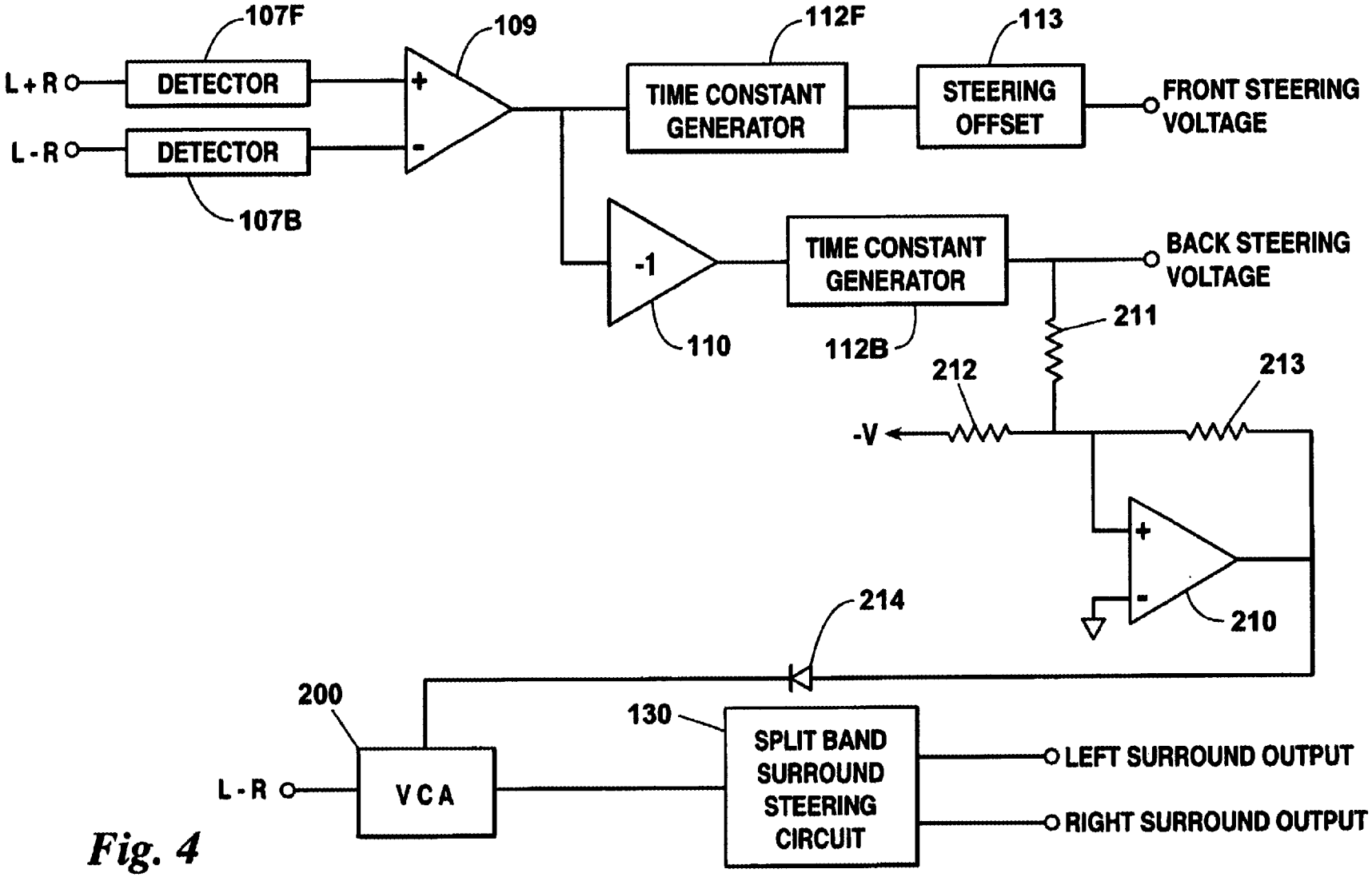
FIG. 4 is a partial block/partial schematic diagram of a surround channel separation enhancement circuit that can be added to the existing Circle Surround 5-2-5 matrix decoder.

As previously mentioned, the requirements of the stand alone 5-2-5 matrix system differ from that of the combination of the disclosed invention, and further improvements in performance are derived by providing surround channel attenuation when there is no dominate L−R signal present. In the stand alone 5-2-5 matrix system disclosed in the Waller patent there is no attenuation of the surround (L−R) signal when there is a dominate front center (L+R) input signal. Since the surround channels are first derived by subtracting the right input from the left input, any front center (L+R) signal is automatically cancelled in the surround outputs. When there is a stereo input signal with no strong directional dominance, the surround channels will produce some audible output. When the system is used as a stand-alone decoder this leakage to the surround channels tends to enhance the sonic performance by producing a more surrounding acoustical environment. This is not necessarily the case with the current invention and by reducing this leakage, thereby increasing the channel separation, greater localization of each individual channel output is realized. Referring to FIG. 4, a partial block/partial schematic diagram is shown. Similar numbers to those used in FIG. 1 of the '295 patent to Waller are used to designate the similar circuitry. The VCA (voltage controlled amplifier) circuit 200 is added in the L−R audio path of the 5-2-5 matrix decoder disclosed in the Waller 295 patent. The L−R signal is fed to the input of VCA 200 to allow additional control for enhancing the surround channel attenuation. Difference amplifier 109 provides the difference signal of L+R detector 107F and L−R detector 107B. This output voltage will be positive when a dominate L+R, or front signal is detected and negative when a dominate L−R, or back signal is detected. The inverting amplifier 110 output will be positive when a dominant back or surround signal is present at the input. Time constant generators 112F and 112B smooth the output signals for both front and back steering voltages. An operational amplifier 210 controls VCA 200 and provides a positive output voltage when there is no positive output from time constant generator 112B. The positive output offset at amplifier 200 will cause attenuation in the output of VCA 200, thereby attenuating the stereo surround channels that are generated in the steering circuit 130. When a dominate L−R surround signal is present, the back steering voltage at the output of the time constant generator 112B will be positive. This will cause the output of the amplifier 210 to go negative which in turn increases the gain of the VCA 200. The net result is that the surround channels return to full gain. A diode 214 prevents the gain of the VCA 200 from exceeding a unity condition, thus clamping the VCA 200 at a gain of 1. The amplifier 210 has input and feedback resistors 211 and 213, respectively. Another resistor 212 provides a negative bias to the negative input of the operational amplifier 210 which causes a positive offset at the output. Anyone skilled in the art will realize that the gain of the amplifier 210 as well as the control law of the VCA will determine the amount of attenuation produced. This additional attenuation will greatly increase the channel separation of the L−R channels of the 5-2-5 matrix decoder(s).

Figure 5:
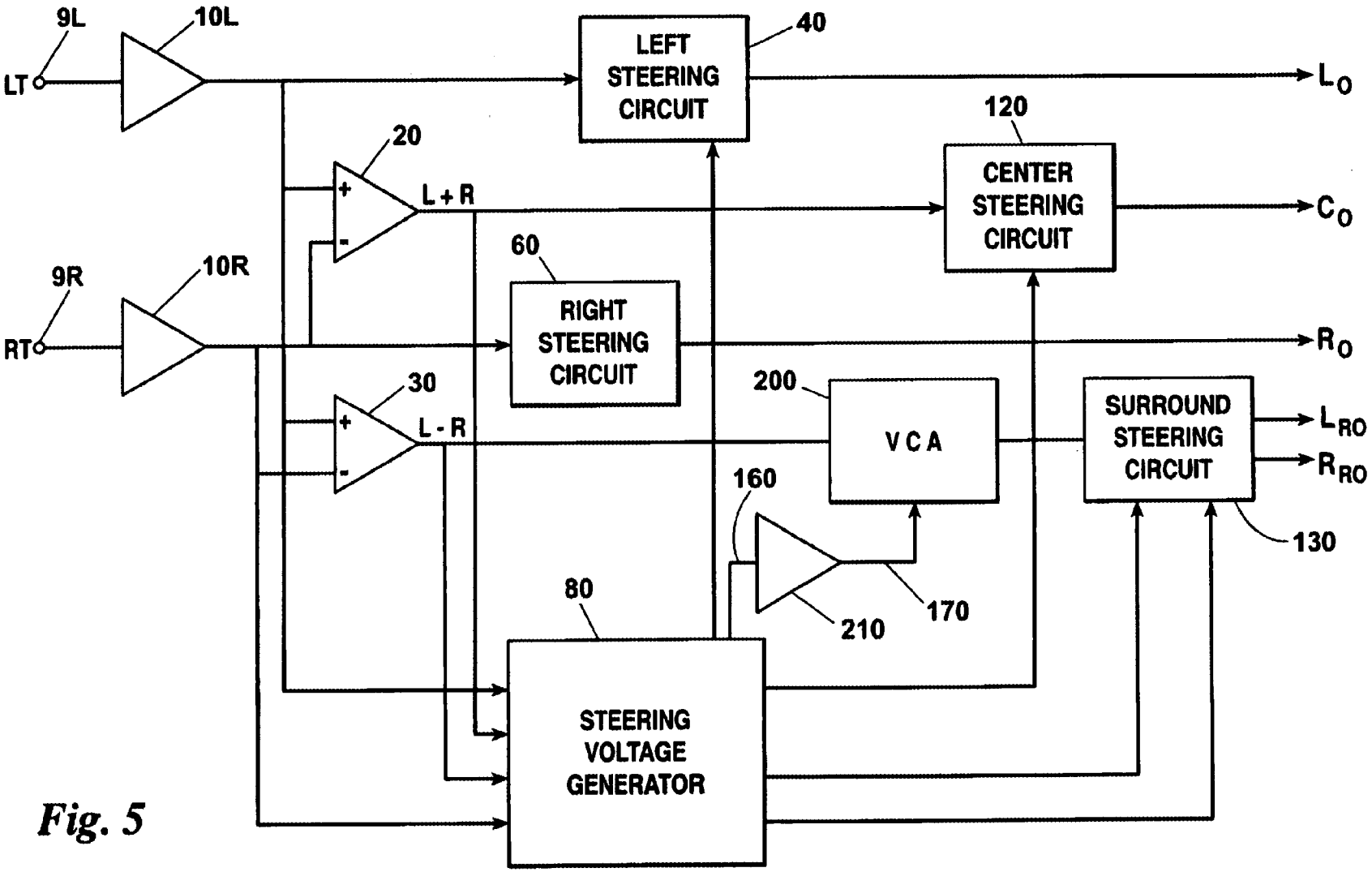
FIG. 5 is a block diagram of the full 5-2-5 decoder which incorporates the improvements shown in FIG. 4.

Referring now to FIG. 5, a block diagram of the 5-2-5 decoding system is shown, incorporating the additional improvements described in FIG. 4. The 5-2-5 decoding system is fully described in the '295 patent to Waller. The improvements to the 5-2-5 decoding system are explained above. FIG. 5 is provided for further clarification of the full 5-2-5 decoding system encompassing the improvements providing enhanced surround channel separation. The LT (Left total) and RT (Right total) input signals, are applied to the inputs of the 5-2-5 decoding system at 9L and 9R respectively. Buffer amplifiers 10L and 10R buffer the input signals and provide sufficient output current to drive the additional decoder circuitry. A summing amplifier 20 provides an output signal which is the summation of the left and right inputs. This L+R output drives the center channel steering circuit 120, as well as providing the L+R input to the steering voltage generator 80. A difference amplifier 30 provides an output signal L−R which is the difference of the two input signals. The L−R output feeds the input to the VCA 200 and also provides the L−R input to the steering voltage generator 80. The steering voltage generator 80 also receives left and right inputs directly from buffer amplifiers 10L and 10R. The output of the operating amplifier 210 is connected to the control port of the VCA 200. The input of the amplifier 210 receives an output signal from steering voltage generator 80. The output signal 160 from the steering voltage generator 80 to the amplifier 120 is defined as the Back or Surround voltage. This output voltage will be zero in the absence of any dominant surround information in the input signal, and will go positive when a dominant surround input signal is present. The output of the VCA 200 feeds the input of the surround steering circuit 130. The surround steering circuit 130 provides the two surround output signals of the 5-2-5 decoding system. Left, and right front outputs Lo and Ro, respectively, of the system are provided by the left steering circuit 40 and the right steering circuit 60. The steering voltage generator 80 senses the input signals L, R, L+R and L−R and generates output steering voltages to control the left, right, center and surround steering circuits 40, 60, 120, and 130. As previously described, when no dominant surround information is present, the back, or surround, output signal 160 will be at zero volts. The amplifier 210 will produce a positive offset voltage at its output, which will cause the VCA 200 to attenuate. This will increase the channel separation of the 5-2-5 decoder by reducing any nominal leakage that would otherwise occur. To further explain, center channel inputs are encoded as L+R signals and are naturally cancelled out in difference amplifier 30. Dominate left or right inputs will also be attenuated in the surround output channels, as they will be steered down in the operation of surround steering circuit 130. When a left and right stereo input signal, with no dominance in one of the inputs, is fed to the input of the system, leakage will occur in the surround output channels. By attenuating the VCA 200 under this condition, the leakage is reduced and channel separation is improved. When a dominant surround signal is present at the input of the 5-2-5 decoder, the back steering voltage at 160 will go positive. When the output signal 160 goes positive, the VCA 200 will produce a unity gain output, thereby providing the input of the surround steering circuit 130 with a full amplitude input signal. The surround steering circuit 130 will produce the final stereo surround outputs by steering the L−R signal to the proper output based on the steering voltages at the output of the steering voltage generator 80.

Thus it is apparent that there has been provided, in accordance with the invention, a discrete multi-channel/5-2-5 matrix system that fully satisfies the objects, aims and advantages set forth above. While the invention has been described in conjunction with specific embodiments thereof, it is evident that many alternatives, modifications and variations will be apparent to those skilled in the art and in light the foregoing description. Accordingly, it is intended to embrace all such alternatives, modifications, and variations as fall within the spirit of the appended claims.

What is claimed is:

1. For use in transmitting eleven discrete audio signals using a five channel digital encoder and a five channel digital decoder, a process comprising the steps of:

encoding a first set of five of the discrete audio signals into first two-channel stereo;

encoding a second set of another five of the discrete audio signals into second two-channel stereo;

encoding the remaining discrete audio signal and said first and second two-channel stereos into a digital bit stream;

decoding said digital bit stream into a discrete audio signal and third and fourth two-channel stereo;

decoding said third two channel stereo into a third set of five discrete audio signals; and decoding said fourth two channel stereo into a fourth set of five discrete audio signals.

2. For use in transmitting eleven discrete audio signals using a five channel digital encoder and a five channel digital decoder, a process comprising the steps of:

encoding a first set of five of the discrete audio signals into first two-channel stereo using a first 5-2-5 matrix encoder;

encoding a second set of another five of the discrete audio signals into second two-channel stereo using a second 5-2-5 matrix encoder;

encoding the remaining discrete audio signal and said first and second two-channel stereos into a digital bit stream using the five channel digital encoder;

decoding said digital bit stream into a discrete audio signal and third and fourth two-channel stereo using the five channel digital decoder;

decoding said third two channel stereo into a third set of five discrete audio signals using a first 5-2-5 matrix decoder; and decoding said fourth two channel stereo into a fourth set of five discrete audio signals using a second 5-2-5 matrix decoder.

* * * * *